United States Patent [19]

Myers et al.

[11] Patent Number: 4,980,557

[45] Date of Patent: Dec. 25, 1990

[54] METHOD AND APPARATUS SURFACE IONIZATION PARTICULATE DETECTORS

[75] Inventors: Richard L. Myers, Wilkinsburg; Edward L. McCall, Sewickley, both of Pa.

[73] Assignee: Extrel Corporation, Pittsburgh, Pa.

[21] Appl. No.: 202,524

[22] Filed: Jun. 6, 1988

[51] Int. Cl.[5] ..... H01J 27/20

[52] U.S. Cl. ..... 250/423 R; 250/425

[58] Field of Search ..... 250/251, 281, 282, 423 R, 250/425

[56] References Cited

U.S. PATENT DOCUMENTS

| | | | |
|---|---|---|---|
| 3,808,433 | 4/1974 | Fite et al. | 250/425 |
| 3,973,121 | 8/1976 | Fite et al. | 250/425 |
| 4,162,404 | 7/1979 | Fite et al. | 250/423 R |
| 4,209,693 | 6/1980 | Fite et al. | 250/425 |
| 4,347,732 | 9/1982 | Leary | 73/23 |
| 4,423,407 | 12/1983 | Zuckerman | 422/98 |
| 4,524,047 | 6/1985 | Patterson | 324/468 |

*Primary Examiner*—Bruce C. Anderson

*Attorney, Agent, or Firm*—Penrose Lucas Albright

[57] ABSTRACT

Surface ionization technique for detection of airborne particles whereby each particle is pyrolyzed on a hot surface, releasing its chemical constituents, some of which are ionized at the surface, creating a burst of ions that denote the particle's presence. The hot surface is a catalytic material deposited on an inert substrate heated by an internal heating element. Inert substrates are selected to provide mechanical strength, reduce microphonic noise and make a large catalytic surface area achievable, and hence permit high sensitivity while employing reduced quantities of catalytic materials. By locating the heater within the substrate, its electrical parameters are such that the heater power supply can be simplified. The pulses during "on" parts of the "on-off" cycles are filtered out and not counted. In one embodiment the hot sensor surface is biased to a high voltage by a high bias resistor and is coupled to a pulse-counting preamplifier through a capacitor. When there is a burst of positive ions from a heated sensor surface, it causes an immediate drop in the bias voltage which cannot be immediately replaced through the biasing resistor. The result is a negative pulse at a preamp proportional to the number of ions in the pulse which is not affected by what ultimately happens to the ions in a turbulent airstream. Heating is accomplished by a current which is alternating "on" "off".

38 Claims, 8 Drawing Sheets

LM1524
IC1
7406
IC2
Q1 2N2222
Q2 ZN2-907
FERRITE BEAD
Q3 IRF150
HEAT SUNK
Z1 SZ120
0.15Ω SW R103
R9 470Ω
R1 499K
R2 4.99K
R3 909K
C1 0.15μF
C2 0.01μF
R4 1K
+15V
CURRENT SENSOR
COMPENSATION
R53 75K
C8 +1.5μF
P9 100K
CW
R42 1M
IC6 AD532
R17 1M
P2 100K
C4 0.15μ PC
OP07
IC4
R16 150K
R13 133K
IC3
P1 20K 10 TURN TRIM
R15 1.5K
R11 10K
R12 10K
R14 133K
FILAMENT
RESISTANCE
R37 240K
R38 100K
P5 1K
SCALE FACTOR
R33 10K
R59 1K
-15V
Z2
R35 499K
R36 220K
C7 22μ
C9 1μF
C5 PC 0.15μF
R30 1M
IC5
R29 150K
R28 24.9K
IC17
R99 249K
R22 20K
R23 20K
R24 10K
R20 100K
R21 100K
P3 500 VOLTAGE OFFSET
R26 909K
R27 750Ω
OFFSET
R32 100K
P4 10K TRIMPOT
R31 100K
VOLTAGE SENSOR
F
D
A
C

METHOD AND APPARATUS SURFACE IONIZATION PARTICULATE DETECTORS

FIELD OF THE INVENTION

This invention relates to the detection by surface ionization of particulate matter which is borne in a gaseous medium. In particular, it is directed to an indirectly heated surface which is retained at a constant temperature and measures bursts of ions by instantaneous changes in voltage in response thereto in the heated surface.

BACKGROUND OF THE INVENTION

The technology involved, initially described in U.S. Pat. No. 3,808,433, of Apr. 30, 1974, Fite and Myers, is directed to detection of small particulate matter and macromolecules by a process in which particles that impact onto a hot surface are partially or completely pyrolysed and a thermal and electrochemical equilibrium is established between the particles' atomic and molecular constituents and the surface. This equilibrium causes positive and/or negative ions to form at the surface which erupt as a burst of ions from that surface to be collected elsewhere as ion pulses which are counted and provide information regarding the impacting particles. Details regarding the types of materials suitable for hot surfaces and the sizes and chemical compositions of particles that may be thus detected are discussed in U.S. Pat. No. 3,808,433.

A technique whereby measurement of the direct current (dc) of ions leaving the hot surface provides a basis for deduction of additional information about the particulates is disclosed in U.S. Pat. No. 4,151,414 of Apr. 24, 1979, Fite and Myers, incorporated herein by reference. If, for instance, the dc reading is high, but the count rate is low, then it is likely that either the particles are very large or that they are relatively rich in surface-ionizable constituents.

From the disclosure of U.S. Pat. No. 4,162,404, it will be appreciated that it is not necessary to use pumps or fans to draw the particulate-laden air into a chamber for the purpose of impacting the particulates onto the hot surface if the air is already flowing at an appreciable speed such as in a duct, stack, pipe or the like. Thus, the detector can take the form of a particle counting and total dc ion current measurement.

The above mentioned patents are incorporated by reference herein as are related U.S. Pat. Nos. 3,973,121 and 4,093,855, for their disclosures relative to the background of the instant invention.

In one of the inventions described above, a platinum or platinum alloy wire heated resistively to a temperature suitable for surface ionization and which also caused emission of visible light was used as the sensor surface. To maintain the sensor surface at a constant temperature in a moving gaseous stream of varying speed and temperature, the visible radiation emitted by the platinum wire was electronically measured and the resultant signal integrated into circuitry that automatically adjusted the voltage to the wire to maintain a steady temperature. This means for maintaining constant temperature was substituted for prior art that measured electrical resistance of the wire to determine and maintain a constant temperature. In earlier techniques the wires were subject to oxidation and erosion and chemical attack by moving gaseous streams; consequently their diameters and hence their resistances changed for reasons other than their temperature. Thus, under the circumstances, electrical resistance was considered unsatisfactory as a measurement of temperature.

The overall methodology disclosed in U.S. Pat. No. 4,162,404 and earlier inventions were subject to limitations and exhibited disadvantages which will now be briefly discussed.

If sensor surfaces are heated by directly passing electrical currents therethrough, the selection of suitable sensor surfaces is limited to electrically conductive materials that, in addition to having the necessary attributes for particle detection, must also be satisfactory electrical conductors for their function. At the same time, the sensor surfaces must not oxidize in gaseous media to which they may be exposed at the high temperatures required for particle detection and they must also exhibit the necessary mechanical properties under all conditions to which they may be exposed. These restrictions have, as a practical matter, limited the choice of sensor material to platinum and a few of the other precious metals and alloys thereof. But, there are a number of other candidate materials for surface ionization sensors, including but not limited to the other precious metals and their oxides, tungsten oxide, and many of the transition metals, which have been excluded from use because they are unable to serve as their own resistive heating elements in an oxidizing or corrosive environment or provide adequate mechanical strength or both.

When an element of wire or ribbon of metal is being heated by passage of an electric current, and in the process becomes slightly more narrow at some place due to oxidation, abrasion or corrosion, then that "more-narrow" place subsequently becomes hotter than other portions of the wire or ribbon due to its greater electrical resistance. That elevated temperature then accelerates the oxidation or corrosion process at the location involved, resulting in the element's burnout although most of the element's material is still usable for particle detection.

Practical considerations of heating a sensor's catalytic surface with currents and voltages which are reasonable and available by conventional techniques mandate that the surface be a thin wire or ribbon or the like. As a result, the surface may be mechanically more fragile than desirable, particularly when operated at an elevated temperature in the presence of vibration and in turbulent airstreams. If there is mechanical vibration of the sensor surface vis-a-vis the collector electrode, the device functions as a capacitance microphone with an attendant electronic noise that limits the device's ultimate sensitivity. Moreover even if the wire or ribbon is quite thin and fragile, it still requires relatively high currents at relatively low voltages. Available power sources which satisfy these requirements tend to be relatively inefficient and the wiring and electronic connectors required to handle high currents are bulky and expensive.

U.S. Pat. No. 4,162,404 relates to means for controlling a catalytic sensor surface's temperature when the moving airstream varies in speed and temperature, and as the surface erodes, oxidizes or evaporates. The patent teaches use of a photocell and related circuitry to monitor the visible or infrared light emitted by the heated surface and to control the circuitry so as to maintain a constant intensity of light and hence a constant surface temperature. This, however, increases the sensor's size and complexity, and generally precludes its use in applications in which simplicity and cost are of paramount importance; furthermore, the technique cannot be used when high background levels of visible or infrared light are present.

It will thus be understood that a need exists for an instrument in which the catalytic surface which provides the pyrolytic and ionization processes can be selected and engineered without undue constraints imposed by size, form, electrical characteristics, or any requirements which lead to undue complexity, considering in particular the desirability of using off-the-shelf electrical electronic components in contrast to custom built components. For most industrial applications, the catalytic surface should be generally substantially more rigid than is normally possible to achieve with a wire or ribbon so that microphonic noises do not limit ultimate sensitivity. It is generally desirable that the configuration of the sensor be as simple as possible. Finally, it is desirable that the power required to heat the sensor to effective temperatures be at higher voltages and less current than prior art devices.

SUMMARY OF THE INVENTION

The invention disclosed herein provides solutions to the problems discussed above by separating the function of the hot sensor surface from that of the heater whereby each element is designed to optimize its function. Specifically, the hot sensor surface is a thin layer deposited onto an inert substrate, which is heated via an embedded internal element.

The microphonic electronic noise due to mechanical vibration is substantially eliminated or greatly reduced because a ceramic substrate piece is utilized which is typically in the form of a rod one to two inches in length and 1/32" to 1/16" in diameter that is several orders of magnitude stronger and more rigid than prior art metallic wires or ribbons 0.005" to 0.010" thick.

Because the heater is no longer exposed to the airstream, it is not subject to chemical corrosion or abrasion. Furthermore, because the heater is sealed inside of and mechanically supported by a ceramic substrate, it may be made in the form of a longer, thicker wire, so that the effect of small changes in its diameter due to evaporation do not affect its electrical resistance by as much as when the heater is in the form of a thin ribbon 0.002" thick, as might be the case using prior technology wherein the evaporative loss of thickness in just one year would cause an increase of 5% in electrical resistance, or, at a nominal operating temperature of 900° C., an error of +60° C., in estimated temperature. This would cause the control circuitry to lower the actual temperature of the ribbon by 60 degrees so as to make the electrical resistance match the "correct" value. This is the reason a photocell was introduced to monitor the visible light from the circuit as an estimate of temperature for control purposes.

In the instant invention, however, a longer heater wire of say approximately 0.012" in diameter may be used. The change in electrical resistance caused by evaporation of 0.0001" of material in the course of one year is 1.7%., leading to a more acceptable temperature error of +20° C. Thus by embedding the heater, not only is corrosion eliminated, but a configuration may be used that reduces the unfavorable effects of evaporation so that resistance-control regulation of the sensor's temperature is again feasible with the attendant elimination of the complexity and expense of optical methods. Further, heater materials such as tungsten or molybdenum (which have good thermal properties but oxidize rapidly in air) may be employed if the heater is hermetically sealed.

By removing the restriction that the sensor material be both mechanically strong and a good electrical conductor, the range of sensor materials available is increased. For instance, rhenium oxide, which has a higher work function than pure platinum and is superior for some applications, can be used in the form of a thin layer deposited on top of, or alloyed with, a layer of platinum—the latter being present to provide an electrical contact for biasing purposes.

A further advantage of the indirect heating method arises from power supply considerations. As a rule of thumb, solidstate power transistors have an innate internal voltage drop of about 0.2 volts when fully turned on. This means that if such a device is being used to drive a high current through a low-resistance load, the efficiency will be limited by the transistor itself. For example, if twenty amperes are to be driven through a resistive load of 0.1 ohms, then the voltage across that load will be $V=IR$ or $20\times0.1$ which equals 2.0 volts. Thus, approximately 10% of the applied voltage (and power) goes toward overcoming the junction resistance of the transistor. This limits the potential efficiency of the device to about 90% in an on/off switching device and also creates significant source of heat. On the other hand, if the resistive load is one ohm, the same power is generated by a current of about six amperes driven by a voltage of about six volts. In this case, the potential efficiency increases to 98%.

Because the ceramic substrate is thermally massive, it maintains a constant temperature eve if the heater wire embedded inside it is undergoing large temperature fluctuations. Accordingly, power to the heater may be supplied in pulses, say, twenty times per second with short bursts of high voltage and the heating effect is smoothed out by the thermal mass of the ceramic. By applying twenty-five volts, in short pulses, to the heater, the efficiency is increased to $((25-0.2)/25)\times100=99.2\%$. Thus, by using an indirectly heated sensor surface deposited onto a directly heated, thermally massive substrate, the power supply may be designed for extremely high efficiency with attendant miniaturization of circuitry.

Another advantageous feature of the invention deals with the enhanced sensitivity due to increased surface area using a minimal amount of material. The present invention functions well using a layer of platinum estimated about $10^{-6}$ cm in thickness. In a 1.5" long sensor 1/16" in diameter, this corresponds to about $2\times10^{-6}$ $cm^3$ of sensor material needed to achieve a detector cross-sectional surface area of 0.6 $cm^2$. If the same amount of material were used in the form of a wire, the diameter would have to be 0.0003" in diameter. This would have a cross-sectional surface area of only 0.003 $cm^2$—two hundred times less than is provided by the current invention—and would also be very fragile.

In an alternative embodiment of the invention, an electrical bias is provided on the hot sensor surface different than that of the heater and its supply. This means that the sensor surface can be biased at high positive or negative potentials or at changing voltages while the heater supply is conveniently referenced to ground. If the bias voltage is applied through a resistor, then, upon the departure of an ion pulse from the hot sensor surface, there is a brief drop in the bias potential while the replacement current flows through the bias resistor. If a preamplifier is connected, via a capacitor, to the biased sensor, then the voltage fluctuations associated with ion pulses leaving the hot sensor surface may be analyzed as a means of particle counting and analysis. It is also noteworthy that the voltage pulse is sensed before the ions have to traverse a turbulent air gap and become scattered. All that is required is the presence of a nearby surface at a lower potential, so that the necessary electric field is available to induce the ions to leave the surface. This was not possible with prior art devices wherein the entire heater power supply and control circuitry would have to be maintained at the high positive bias potential which introduces so much capacitance into the preamp input that the effect of the ion pulse would not be detectable.

The inventions are illustrated in preferred embodiments in the following accompanying drawings:

DESCRIPTION OF THE PREFERRED EMBODIMENTS

Figure 1A:
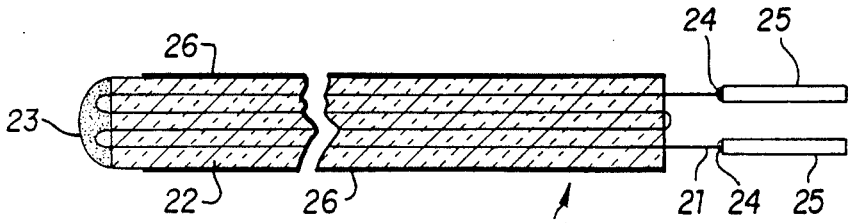
FIGS. 1*a* and 1*b* are diagrammical side elevational views of an embodiment which illustrates the hot sensor surface deposited and heated in accordance with the invention.

Referring to FIGS. 1*a* through 7, a sensor, designated generally by reference numeral 17, which is intended to contact dust-laden gas to be measured, comprises a heater wire 21, which may be any of the precious metals or certain alloys thereof, or, if the construction is such that its hot portions are sealed and protected from air, may be made from any suitable refractory metal with sufficiently high melting point. Heater wire 21 is threaded through a ceramic piece 22, said ceramic piece 22 containing a number of bores, four being shown, which are distributed so single continuous piece of heater wire 21 forms a substantially uniform thermal relationship with the outer surface of ceramic piece 22. Minimal end-loops of heater wire 21 are protected by application of a ceramic sealant 23. The ends of heater wire 21 are connected via braised or welded joints 24 to thicker current leads 25 made of a good electrical conductor such as copper or nickel. Ceramic piece 22 is coated with a thin layer of a sensor material 26 such as platinum, tungsten oxide or any other of a number of materials known to the art as being applicable for surface ionization.

Techniques which may be used for the deposition include vacuum sputtering, evaporative coating, and the pyrolytic decomposition of metal organic compounds/suspensions such as marketed under the trademark "Platinum-Bright".

Figure 1B:
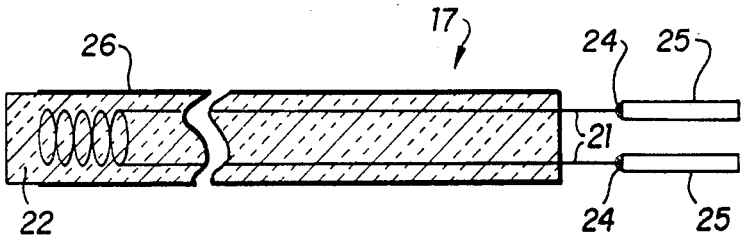

Heater wire 21, in a typical preferred embodiment, is approximately 0.012" in diameter and composed of pure platinum, or it may be platinum-rhodium, threaded lengthwise across a two inch ceramic piece 22 composed of pure aluminum oxide. Ceramic piece 22 is one-sixteenth of an inch in diameter and contains four channels or bores, each one sixty-fourth of an inch in diameter. FIG. 1*b*, however, depicts an embodiment in which the heater wire 21 is formed into a coil within ceramic piece 22. In this case, ceramic sealant 23 is not needed.

Figure 2:
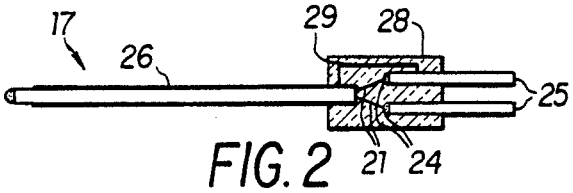
FIG. 2 is a side elevational view that depicts a cross-section of sensor surface prepared for insertion into an outer cylinder.

In FIG. 2, sensor 17 is shown with the brazed connection 24, between heater wire 21 and thicker leads 25, protected by being encased in a casting 28 composed of a commercially available aluminum oxide two-component potting compound. A platinum wire 29 has been connected to surface 26 on one end and to that one of heater leads 25 which will ultimately be used as the electrical common for the heater circuit. Wire 29 is also protected by the ceramic casting 28 by being embedded therein.

Figure 3:
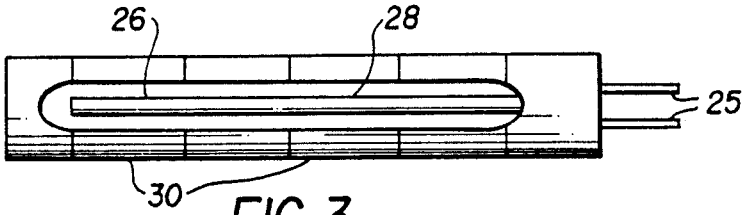
FIG. 3 shows the sensor assembly in side elevation and cross-section mounted inside a slotted tube that also serves as an ion collector.

A slotted tube 30 is shown in FIG. 3 which has been slid onto and is disposed over ceramic casting 28 so that particulates in a moving airflow impact onto the hot sensor surface 26, thereby creating ion pulses which are collected onto the inside surface of slotted tube 30. It will be appreciated that tube 30 also serves to protect sensor surface 26. Heater current leads 25 are left exposed to receive or be received by electrical connections.

Figure 4A:
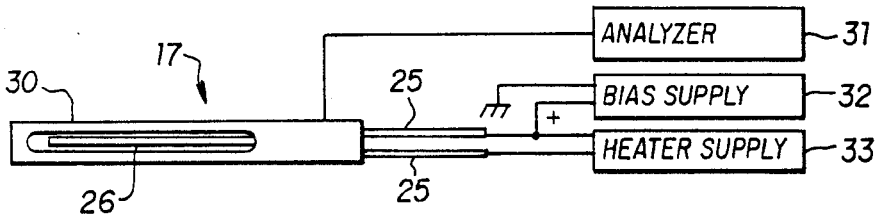
FIGS. 4*a* and 4*b* illustrate diagrammically two electronic circuits that permit differential biasing of the hot sensor surface vis-a-vis the ion collector and that couple the ion pulse information into a pulse analysis circuit.

In FIG. 4*a*, an embodiment is shown in which an ion signal analyzer 31 is connected to the slotted ion collector tube 30, and the heater power supply 33 is biased to a high positive voltage via a bias supply 32. The internal heater wire 21 (FIGS. 1*a* and 1*b*) is heated to a high temperature by application of current to the current leads 25 from the external heater power supply 33. Because the sensor surface 26 is internally connected to the heater common, an electric field is thereby created that has the effect of causing the ion pulses to move quickly away from the hot sensor surface 26 to the slotted collector tube 30.

Figure 4B:
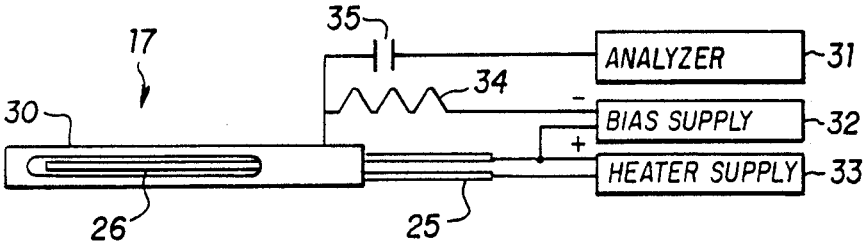

A somewhat different embodiment is depicted in FIG. 4*b*. Here, a resistor 34 has been attached to collector tube 30, so that an external voltage supply 32 creates a voltage differential between collector tube 30 and filament lead 25 to which the plated hot sensor surface 26 is internally attached. Likewise, a capacitor 35 couples ion pulses generated from surface 26 to the ion signal analyzer 31.

Figure 5:
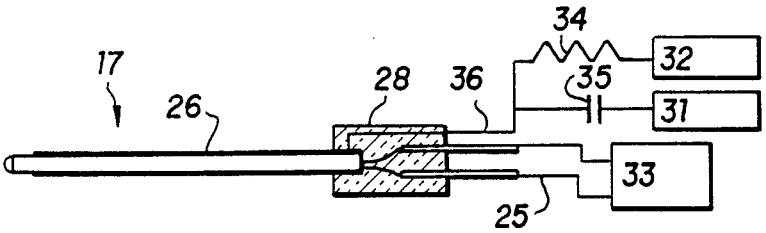
FIG. 5 depicts diagramically a alternative embodiment of the invention wherein the ion collector is eliminated and each particle is instead measured as a decrease in the positive bias voltage on the sensor surface due to departure of a positive ion pulse.

FIG. 5 illustrates an alternative embodiment of the invention wherein slotted collector tube 30 and the wire 29 have been eliminated; instead, a wire 36 is brought out through the ceramic casting 28 for the purpose of connecting the bias resistor 34 and the coupling capacitor 35 directly to the hot sensor surface 26. In this configuration pulse analyzing circuit 31 senses positive ion pulses as negative fluctuations on dc voltage applied through bias resistor 34.

Figure 6:
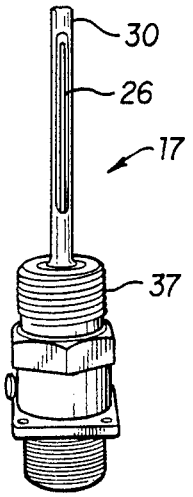
FIG. 6 is a perspective view of an on-board coupling capacitor and biasing resistor imbedded in potting compound and the entire sensor integrated onto a pipe nipple or other convenient fixture for mounting the sensor onto a duct, manifold or vehicle.
Figure 7:
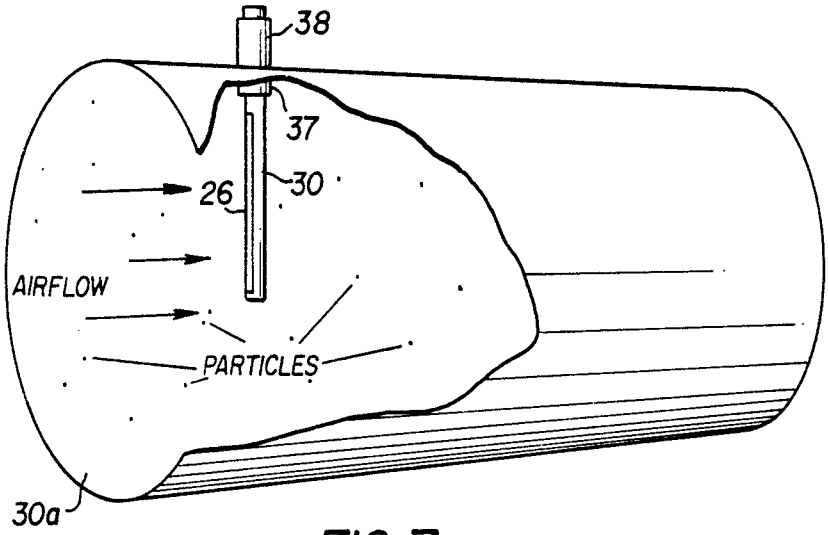
FIG. 7 is a broken perspective view showing the device in an airstream.

FIG. 6 illustrates how the device is incorporated into a mechanical housing for actual use. If the configuration shown as FIG. 4*a* is being used, then the filament leads 25, the right-hand end of slotted tube 30, and the electronic cable which connects analyzer 31 to slotted tube 30, are embedded, using a suitable potting compound, inside a pipe fitting 37. Slotted collector tube 30, with its internally mounted hot sensor surface 26, is mounted in a moving airstream in a manner similar to that shown in FIG. 7. Pipe fitting 37 is attached and hermetically sealed to an electronic connector 38 which has pins extending downwardly therefrom for easy connect and disconnect of a cable, not shown, that interfaces with electronics represented by analyzer 31, bias supply 32 and power supply 33. If the electronic configuration of FIG. 4*b* is used, then resistor 34 and capacitor 35 are also embedded inside fitting 37. If the "collectorless" configuration shown as FIG. 5 is used, then the appearance will be similar to that of FIG. 6, except that slotted tube 30 is not present and sensor surface 26 is presented directly to the airstream as illustrated in FIG. 5. Also the pipe 30*a* is conductive and surface 26 is biased positively relative to a nearby interior conductive surface of pipe 30*a*. Referring to FIG. 7, the number of particles travelling down a duct per second equals the count rate of particles intercepted by sensors surface 26 multiplied by the ratio of the duct's cross-section to that of the sensor surface. Thus, the invention possesses an advantage over instruments which measure only particulate concentration which in turn must be multiplied by a measured flow rate to calculate actual particulate transport down the duct.

Figure 8:
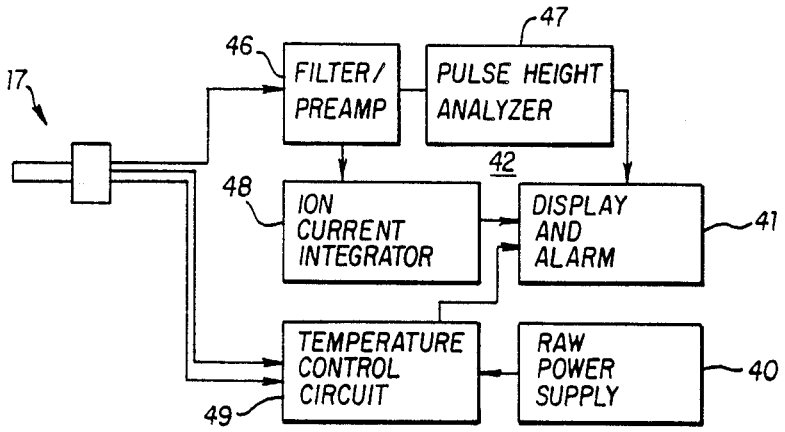
FIG. 8 is a block diagram of typical circuitry associated with the invention.

A more detailed block diagram of the circuitry associated with sensor 17 is illustrated in Figure 8. Here, analyzer 17 is composed of three functional parts. Electronic filter 46 amplifies only those current pulses with rise times close to one hundred microseconds which is characteristic of ion pulses produced by pyrolysis and subsequent surface ionization of particulates. The subsequent pulse height analyzer 47 counts all pulses larger than an adjustable value, thus providing information about particle number density. Concurrently, an ion current integrator 48 provides information related to the total mass of the particulates. A temperature control circuit 49 maintains sensor 17 at a constant temperature in spite of changing ambient temperature and airflow speed. The raw power supply 40 may be the either a direct current source, such as the on-board battery of a vehicle, or an alternating source, such as normal household current.

An advantage of the invention is that, because the hot sensor surface 26 may be held at a potential independent from that of the heater wire 21, or may be connected to that end of the heater wire which is at circuit common, then the heater wire may be provided with power from a high-frequency alternating source or even a pulsating source that, with prior technology, would introduce excessive electrical noise into the counting circuitry 42. Another advantage is that, because ceramic piece 22 has a much greater thermal mass than the thin ribbon or wire characteristic of prior state of the art, internal heater 21 can be pulsed at a low frequency without causing the fluctuations in temperature that would occur using ribbons or wires. These two advantages make possible a compact, lightweight relatively simple, and at the same time a very efficient temperature control circuit 49.

Figure 9:
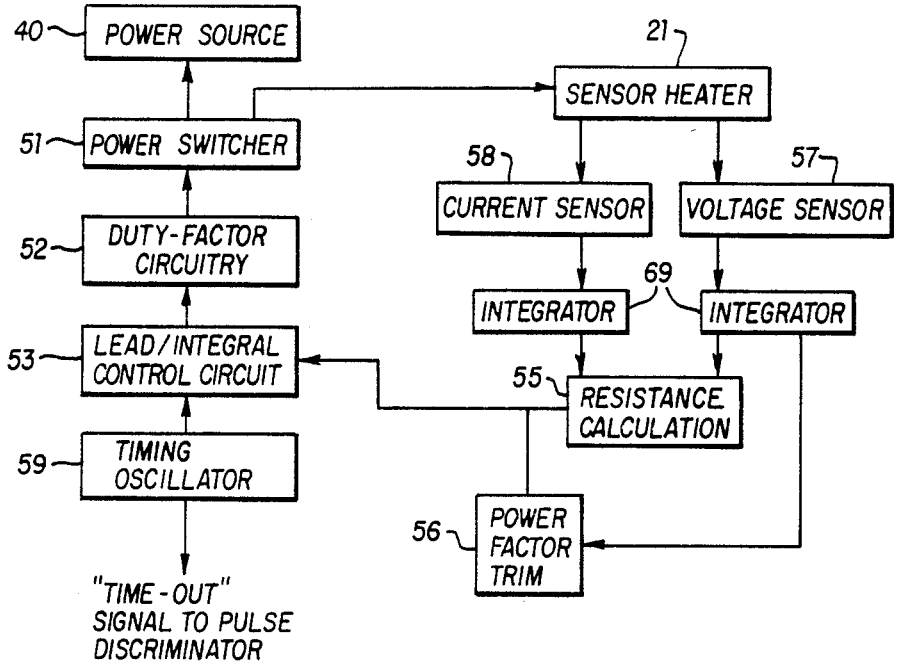
FIG. 9 is a diagram of the circuit for controlling the temperature of the sensor surface.

FIG. 9 depicts in more detail a preferred embodiment of this circuitry. Raw power supply 40 is alternately turned on and off by means of a power switcher circuit 51 which may be a bipolar or MOSS-FET power transistor and associated circuitry. The frequency with which the raw power is applied is fixed by a timing oscillator 59. If the raw supply is dc, as in a vehicle battery, the frequency is typically set at 20–40 Hz. If, on the other hand, 60-cycle line voltage is being used, oscillator 59 may be synchronized with the 60 Hz. Thus with the frequency being fixed and the raw voltage essentially constant, the average power delivered to sensor heater wire 22 is determined primarily by the length of time per period that the power is turned on; i.e., the duty factor. A duty factor circuitry 52 that turns the switcher on and off receives its input signal from a control circuit 53 which compares an internally fixed set-point with the electrical resistance of the heater wire 22, as calculated by a divider circuit 55, which is governed by heater voltage and current sensed by sensor devices 57 and 58, respectively, and time-averaged by integrators 69. When target resistance and actual resistances differ, control circuit 53 adjusts an analog voltage level utilized by duty factor circuit 52 to control the average power load to the heater. Control circuit 53 also contains lead/integral control circuitry designed to improve the speed and stability of the system by correcting for the thermal lag of the overall sensor 17.

Each time the switcher turns on, and again whenever it turns off, a momentary noise spike of approximately one hundred microsecond duration is induced onto the ion collector 30. If uncorrected, this would introduce into the pulse counting circuitry a background false count rate equal to twice the frequency synchronized to oscillator. This disadvantage is removed by a gating circuit that removes the first few hundred microseconds subsequent to the switcher's turning on or off from data analyzed by the circuits identified as power factor 56, voltage sensor 57 and current sensor 58.

Figure 10A:
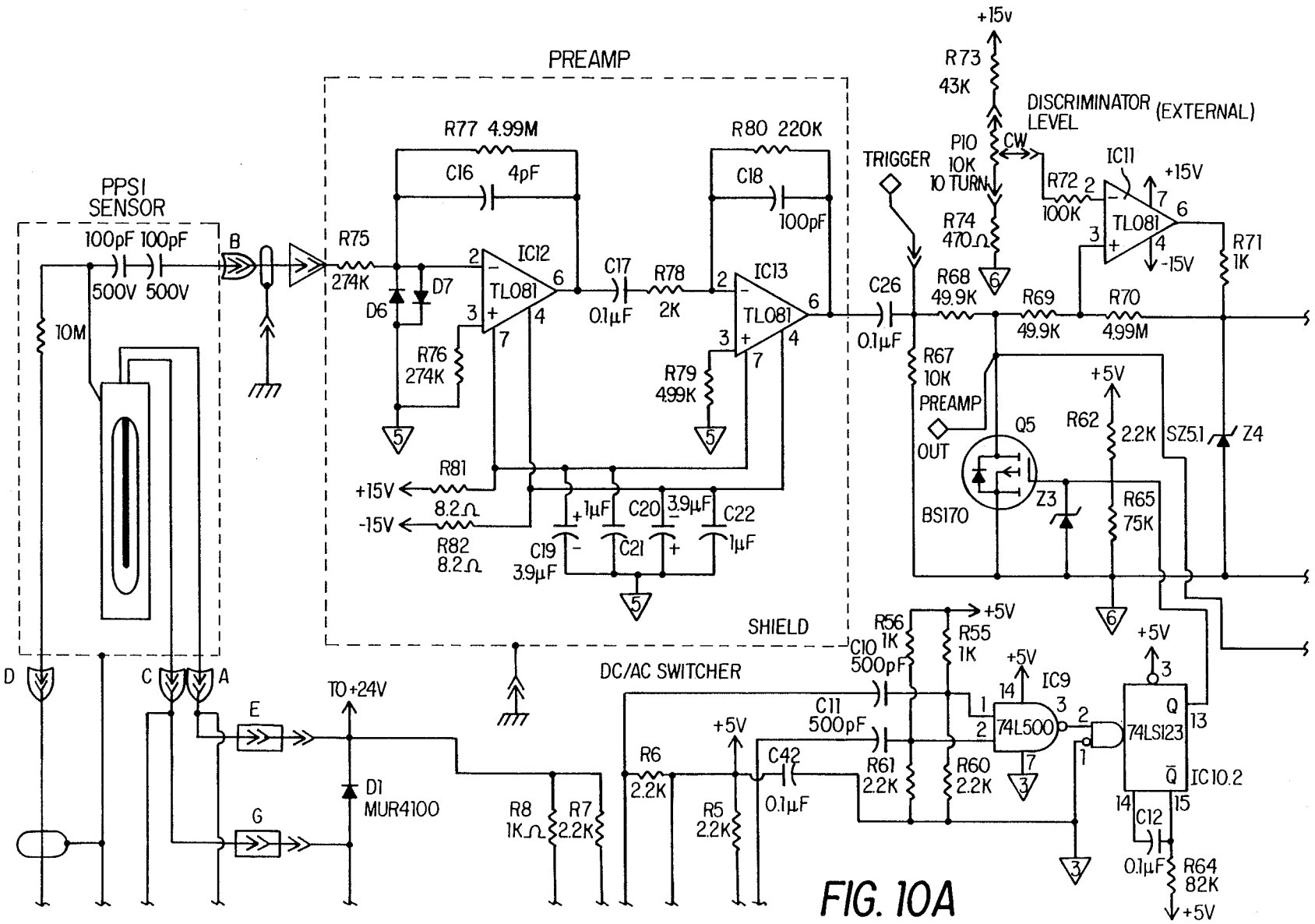
FIGS. 10A, 10B, 10C and 10D are combined to form a detailed circuit diagram of the specific electronic components used in a preferred embodiment of the invention.
Figure 10B:
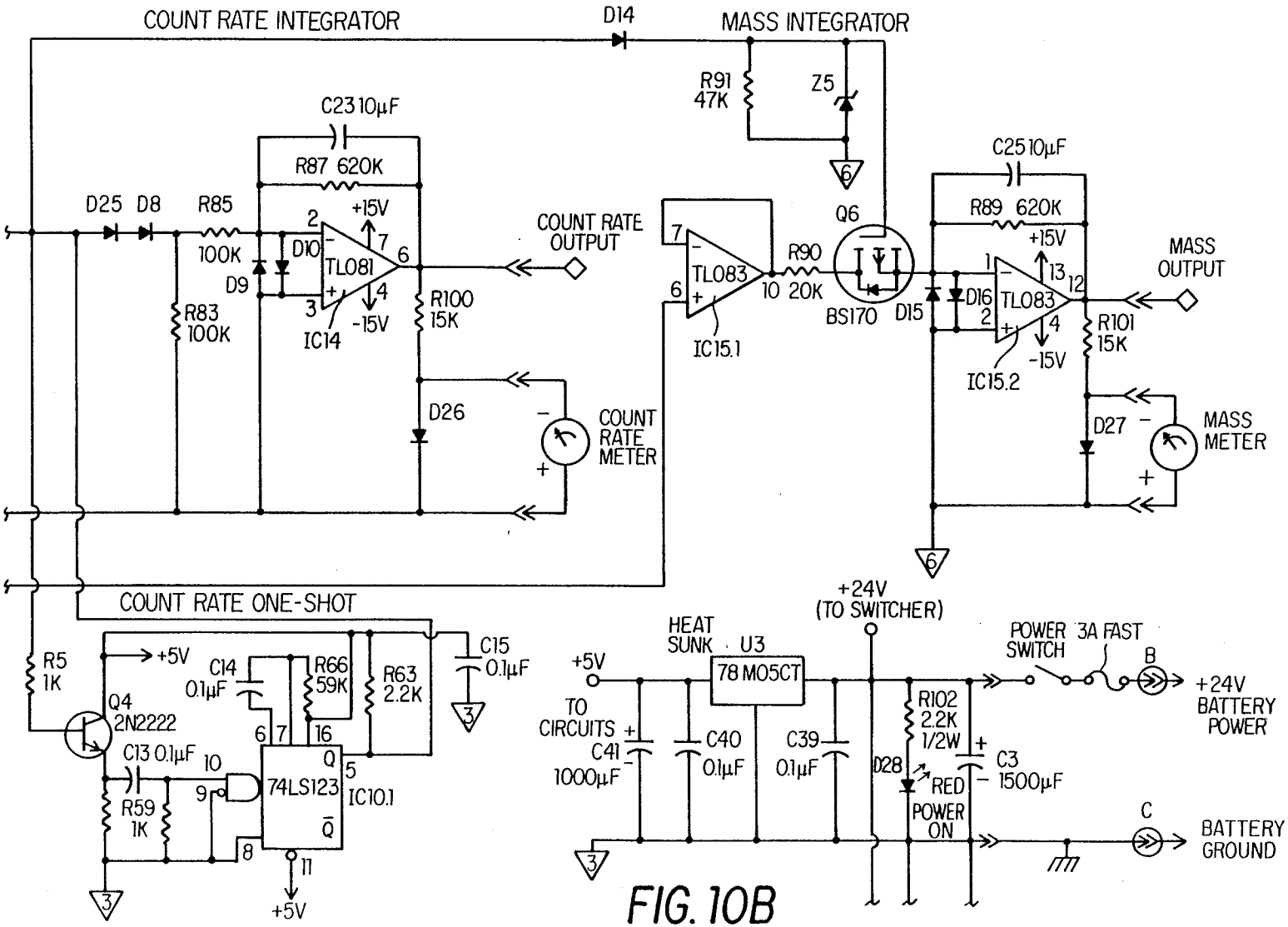
Figure 10C:
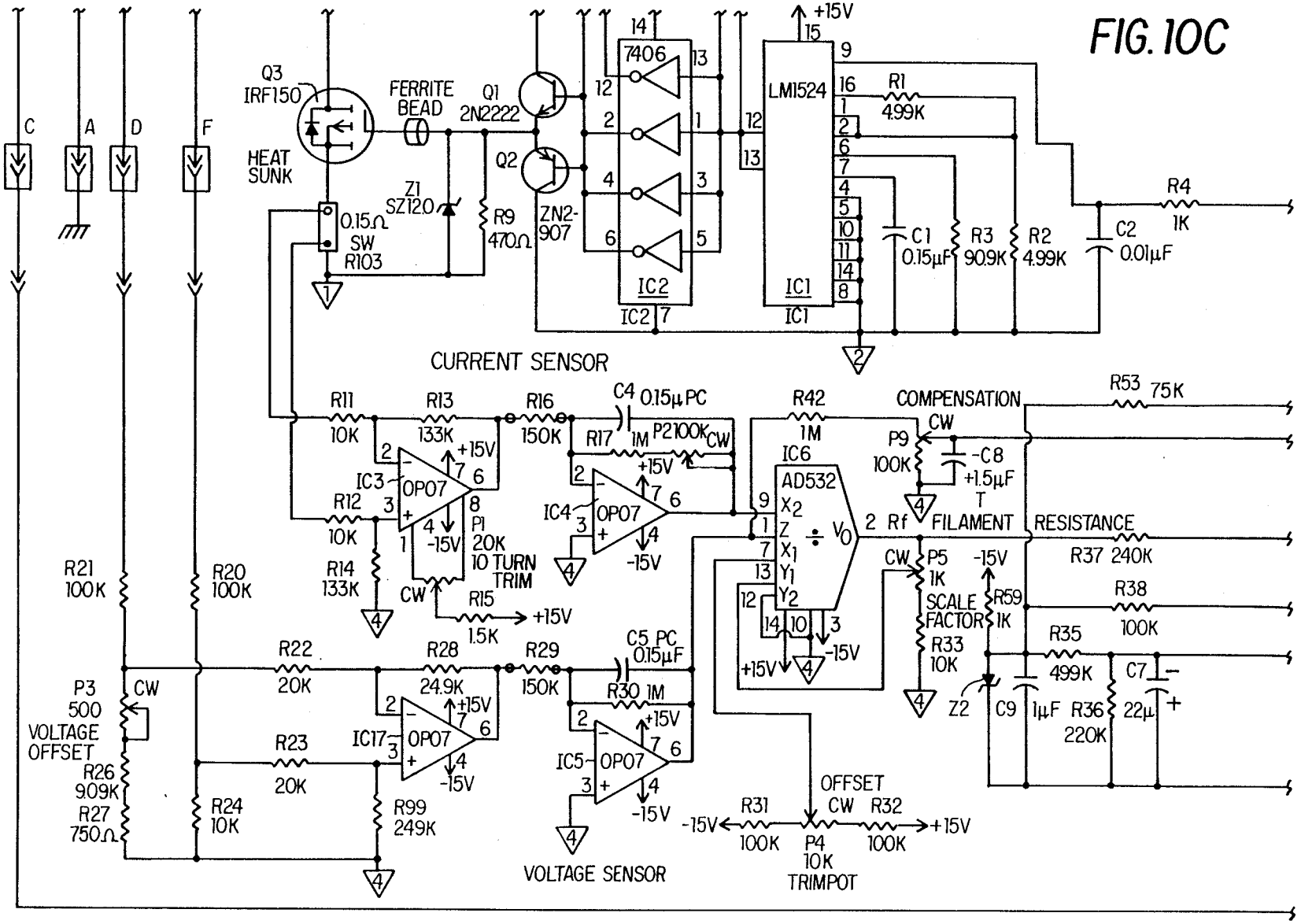
Figures 10, 10D:
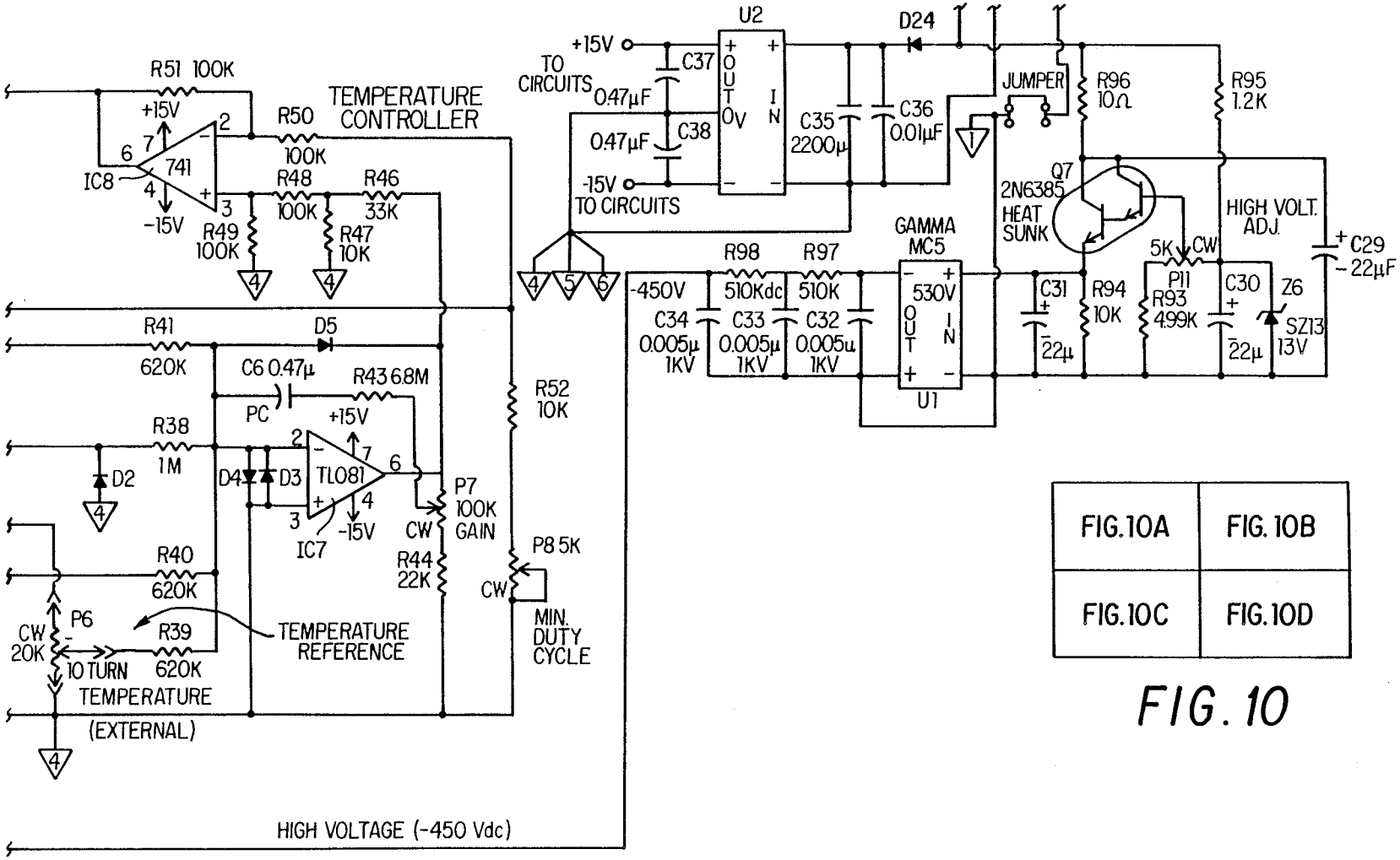
FIG. 10 depicts how

FIG. 10 (FIGS. 10A, 10B, 10C and 10D in combined form) is included to disclose a preferred circuit in some detail. In this drawing, "heat sunk" means the component is mounted so as to dissipate excess heat generation. The triangular grounds are distributed as known to the art, the numerals relating to common locations. Unless otherwise indicated, ordinary electronic symbols and designations are employed.

OPERATION

From FIG. 10, that is, from FIGS. 10A, 10B, 10C and 10D, as shown combined in FIG. 10, as well as the disclosure otherwise, it should be appreciated by these skilled in the art that pyrolysis plus surface ionization technology is used for the detection of airborne particulates. The sensor employs a ceramic tube, 1.5" in length, through which a platinum alloy filament wire is threaded. A platinum surface is deposited on the ceramic tube which is heated by the filament to about 850 degree Celsius. When a particle impacts on the platinum surface, it pyrolizes and its alkali impurities surrender electrons to that surface thereby creating positive ions.

These ions are drawn to the collector tube, which is biased at −450 volts dc.

The Preamp $IC_{12}$ and $IC_{13}$ amplifies these ionized particle pulses to a level of several volts. The Discriminator $IC_{11}$ compares the pulse height with an adjustable trigger level, Discriminator Level $P_{10}$, and makes its output high when the amplitude exceeds this value. In effect it digitizes the analog pulses coming from the Preamp. These transitions are used to trigger the Count Rate One-Shot $IC_{10.1}$ which normalizes the particle pulse duration to a uniform value so that each particle, regardless of size, produces the same average voltage. The one-shot output is then integrated to obtain an analog voltage corresponding to the number of particles present.

The Mass Integrator $IC_{15}$ provides another analog output which instead represents the total mass of particulate. This is accomplished by integrating the Preamp output only when a particle is present, i.e. only when the Discriminator $IC_{11}$ is triggered. The advantage of this technique is that baseline noise and microphonics do not effect the integrator and its output becomes a closer analogue of the total mass present in the desired size range.

Inasmuch as the sensor is subjected to varying airflow velocities, it is necessary to regulate its surface temperature electronically. This is accomplished by using the resistance of the filament wire to sense temperature, such resistance being a function of temperature. Filament resistance is measured by amplifying and integrating ($IC_3$ & $IC_4$) the voltage developed across a current sensing shunt along with the filament voltage itself ($IC_{17}$ & $IC_5$), then dividing them in an Analog Divider $IC_6$. The resulting feedback resistance signal is fed into a PI (proportional integrator) control loop $IC_7$ and compared with a variable temperature reference $P_6$. The error voltage out of the PI controller makes its way to a switching regulator chip $IC_1$ which produces a 100 Hz square wave, the pulse width of which varies with its input voltage. A power TFET ($Q_3$) is then driven by this variable pulse width square and power is delivered in a pulsed width modulated fashion to the filament.

The pulse width modulated switcher control scheme is very efficient. However, there is a disadvantage to this technique. During switching intervals, a considerable voltage is induced in the collector which is sufficient to saturate the Preamp. If the Preamp output were not conditioned to eliminate these excursions, false counts synchronized with the switcher frequency would occur. The Clamp circuit ($IC_9$, $IC_{10.2}$ and $Q_5$) circumvents this problem. It uses a switching TFET $Q_5$ to zero the input to the Discriminator for a few milliseconds after the turn on and turn off of the filament. A retriggerable be one-shot $IC_{10.2}$ triggered two outputs from the temperature control circuit synchronizes the TFET with the switching of the filament. The loss in sensitivity from the "dead time" that occurs is not a problem with this application. In this application it is more important to transfer power with a efficiency of over 99% than it is to have maximum sensitivity, being that this invention is intended primarily for use in mobile applications where power is at a premium. Nevertheless, excellent sensitivity is achieved.

The foregoing detailed description has been provided for clearness of understanding and unnecessary limitations should not be implied therefrom for modifications will be obvious to those skilled in the art which fall within the ambit of the following claims.

Having thus disclosed our invention, what we claim as new and desire to secure by Letters Patent of the United States is:

1. A method of monitoring particulates borne in a surrounding gaseous medium which moves relative to a hot surface, said relative movement causing said particulates to hit said hot surface, decomposing said hitting particulates into corresponding individual ion bursts, collecting said ion bursts onto a nearby electrode which is electrically biased negatively with respect to the electric potential of said hot surface, maintaining said hot surface at a desired temperature by placing it into contact with a non-conducting substrate, heating said substrate by a resistive heating element embedded therein to a controlled temperature, measuring the resistance of said element and controlling the temperature of said element to a substantially constant temperature in accordance with said measurements, using the thermal inertia of the said substrate to maintain a consistent temperature of said hot surface by heating said internal resistive heating element intermittently as necessary and discerning said ion bursts for analyzing said particulates.

2. A method in accordance with claim 1 wherein said further surface is electronically biased at least one hundred volts negatively with respect to the electron current of said hot surface.

3. A method of monitoring particulates borne in a surrounding gaseous medium which moves relative to a hot surface, said relative movement causing said particulates to hit said hot surface, decomposing said hitting particulates into corresponding individual ion bursts, collecting said ion bursts onto a nearby electrode which is electrically biased negatively with respect to the electric potential of said hot surface, maintaining said hot surface at a desired temperature by placing it into contact with a non-conducting substrate, heating said substrate to a controlled temperature and discerning said ion bursts for analyzing said particulates wherein the method of heating said hot surface comprises controlling the duty factor of a power transistor so that said substrate is heated by short pulses of high voltage from said power transistor, whereby the efficiency of the method is increased.

4. A method in accordance with claim 3 which includes the biasing of said nearby electrode to at least 100 volts negatively with respect to the electric potential of said hot surface.

5. A method in accordance with claim 3 wherein said ion bursts are discerned by detecting changes in current from or to said hot surface or said nearby electrode.

6. A method of monitoring particulates borne in a surrounding gaseous medium which moves relative to a hot surface, said relative movement causing said particulates to hit said hot surface, decomposing said hitting particulates into corresponding individual ion bursts, collecting said ion bursts onto a nearby electrode which is electrically biased negatively with respect to the electric potential of said hot surface, maintaining said hot surface at a desired temperature by placing it into contact with a non-conducting substrate, heating said substrate to a controlled temperature and discerning said ion bursts for analyzing said particulates wherein a pulsed current is applied to an electric heater element associated with said substrate to heat same and controlling the heating power to said hot surface comprising measuring said power's current and the voltage applied to said heating element, time-averaging said pulses, electronically calculating said producing an electronic signal proportional to said heater element's resistance, comparing said electronic signal to a reference signal, and causing said heating power to be changed as required to maintain said signals in predetermined relationship.

7. A method in accordance with claim 6, comprising electronically modifying said reference resistance signal by adding an electronic signal proportional to the voltage being applied to said heater element whereby said reference resistance signal is increased and final actual resistance of said heater element is greater when said gaseous stream is a cooling airstream, said added resistance compensating for added resistance of connecting wires, heat losses to supporting structures, and temperature gradient across said substrate when the heater device is subjected to greater applied voltages and currents corresponding to operations in a cooling airstream.

8. A method of monitoring particulates borne in a surrounding gaseous medium which moves relative to a hot surface, said relative movement causing said particulates to hit said hot surface, decomposing said hitting particulates into corresponding individual ion bursts, removing said ions away from said hot surface by means of an electric field between said hot surface and a nearby further surface which is electrically biased negatively with respect to the electric potential of said hot surface, maintaining said hot surface at a desired temperature by placing it into contact with a non-conducting substrate, heating said non-conducting substrate by a resistive heating element embedded therein to a controlled temperature, measuring the resistance of said resistive heating element and controlling the temperatures of said resistive heating element to a substantially constant temperature in accordance with said measurements, using the thermal inertia of said substrate to maintain a consistent temperature at said hot surface by causing an electrical current to flow through said embedded resistive heating element intermittently as necessary, and discerning said ion bursts by detecting the resulting current flow relative to said hot surface for analyzing said particulates.

9. A method of monitoring particulates borne in a surrounding gaseous medium which moves relative to a hot surface, said relative movement causing said particulates to hit said hot surface, decomposing said hitting particulates into corresponding individual ion bursts, removing said ions away from said hot surface by means of an electric field between said hot surface and a nearby further surface which is electrically biased negatively with respect to the electric potential of said hot surface, maintaining said hot surface at a desired temperature by placing it into contact with a non-conducting substrate, heating said non-conducting substrate by a resistive heating element embedded therein to a controlled temperature and discerning said ion bursts by detecting the resulting current flow relative to said hot surface for analyzing said particulates wherein maintaining said hot surface at a desired temperature comprises controlling the duty factor of a power transistor through which current to heat said element passes so that said substrate is heated by short pulses of high voltage form said power transistor, whereby the method's efficiency is increased.

10. A method of monitoring particulates borne in a surrounding gaseous medium which moves relative to a hot surface, said relative movement causing said particulates to hit said hot surface, decomposing said hitting particulates into corresponding individual ion bursts, removing said ion away from said hot surface by means of an electric field between said hot surface and a nearby further surface which is electrically biased negatively with respect to the electric potential of said hot surface, maintaining said hot surface at a desired temperature by placing it into contact with a non-conducting substrate, heating said non-conducting substrate to a controlled temperature, applying pulses of current to an electric heater element associated with said substrate to achieve said heating of same and controlling the thermal power to said hot surface by measuring said power's current and the voltage applied to said heating element, time-averaging said pulses, electronically calculating and producing an electronic signal proportional to said electric heater element's resistance, comparing said electronic signal to a reference signal, and causing said heating power to be changed as required to maintain said signals in predetermined relationship, and discerning said ion bursts by detecting the resulting current flow relative to said hot surface for analyzing said particulates.

11. A method in accordance with claim 10, comprising electronically modifying said reference resistance signal by the addition of an electronic signal proportional to the voltage being applied to said heater element whereby said reference resistance signal is increased and final actual resistance of said heater element is greater when said gaseous stream is a cooling airstream, said greater resistance compensating for added resistance of connecting wires, heat losses to supporting structures, and the temperature gradient across said non-conductive substrate when said electric heater element is subjected to greater applied voltages and currents corresponding to operations in a cooling airstream.

12. An apparatus for monitoring particulates borne in a surrounding gaseous medium which is in motion relative to the apparatus which comprises a metallic sensor surface deposited on an inert substrate which is electrically non-conductive and is heated to a constant temperature by an embedded resistive heater, said metallic sensor surface and said inert substance being mounted rigidly near an ion collector, said ion collector being electrically biased negatively relative to the electrical potential of the metallic sensor surface, said sensor surface being composed of a material having the property of causing said particulates intercepted thereupon to decompose by surface ionization and an ion burst to be emitted from the hot sensor surface for each said particulate's decomposition, each said ion burst being collected on said ion collector, and means for registering each said ion burst having an ion content larger than a predetermined amount.

13. An apparatus in accordance with claim 12 wherein the electrical biasing of said ion collector negatively relative to the electrical potential of said metallic sensor surface is at least one hundred volts.

14. An apparatus in accordance of claim 12 wherein said registering means comprises means for detecting changes in current from or to said sensor surface or said ion collector that result from said ion burst.

15. Apparatus in accordance with claim 12, wherein said sensor surface is composed of platinum.

16. Apparatus in accordance with claim 12, wherein said sensor surface is composed of either tungsten or of a alloy of platinum or one of the precious metals.

17. Apparatus in accordance with claim 12 wherein said sensor surface is composed of a metallic oxide deposited onto or alloyed with a substrate of platinum or other precious metal which in turn is deposited onto said inert non-conducting substrate.

18. Apparatus in accordance with claim 12 wherein said inert non-conducting substrate is composed of aluminum oxide.

19. Apparatus in accordance with claim 12 wherein said inert non-conducting substrate is composed of quartz glass.

20. Apparatus in accordance with claim 12 wherein said embedded resistive heater is composed of platinum or an alloy thereof.

21. Apparatus in accordance with claim 12 wherein said embedded resistive heater is composed of tungsten, molybdenum or other refractory metal and is hermetically sealed inside said inert non-conducting substrate.

22. An apparatus for monitoring particulates borne in a surrounding gaseous medium which is in motion relative to the apparatus which comprises a metallic sensor surface deposited on an inert non-conducting substrate heated to a constant temperature by an embedded resistive heater, said sensor surface and said inert non-conducting substrate being mounted rigidly near an ion collector, said ion collector being electrically biased negatively relative to the electrical potential of said metallic sensor surface and being in the form of a slotted tube, the slots in said tube oriented in said moving gaseous medium so that particulates freely pass through said slots and are intercepted onto said hot sensor surface, said sensor surface being composed of a material having the property of causing said particulates intercepted thereupon to decompose by surface ionization and an ion burst to be emitted from the hot sensor surface for each said particulate's decomposition, each said ion burst being collected on said ion collector, means for registering each said ion burst having an ion content larger than a predetermined amount, and further means being provided whereby said tube may be rotated so as to block the flow of particulates through said slots, said rotation being for the purpose of providing a method of causing said apparatus to register zero counts.

23. An apparatus for monitoring particulates borne in a surrounding gaseous medium which is in motion relative to the apparatus which comprises a metallic sensor surface deposited on an inert non-conducting substrate heated to a constant temperature by an embedded resistive heater and means for controlling the temperature of said metallic sensor surface which includes a circuit that calculates the resistance of said embedded resistive heater as the ratio of applied voltage to current, said calculated resistance being applied to control the duty factor of a switching transistor which is included in said apparatus so that periodically a short pulse of voltage from a power supply is applied to said embedded resistive heater, said sensor surface and inert non-conducting substrate being mounted rigidly near an ion collector, said ion collector being electrically biased negatively relative to the electrical potential of the metallic sensor surface, said sensor surface being composed of a material having the property of causing said particulates intercepted thereupon to decompose by surface ionization and an ion burst to be emitted from the hot sensor surface for each said particulate's decomposition, each said ion burst being collected on said ion collector, and means for registering each said ion burst having an ion content larger than a predetermined amount.

24. Apparatus in accordance with claim 23 comprising additional electronic means for measuring the time at which said burst of voltage begins and ends thereby providing means for subsequent ion pulse counting circuitry to distinguish those electronic signals resulting from decomposition and surface ionization of particulates from those electronic signals resulting from electrostatic and magnetic induction during turning on the turning off of each said burst of voltage being used to provide power to said embedded resistive heater.

25. A method of monitoring particulates borne in a surrounding gaseous medium which is in motion relative to the apparatus comprising a metallic sensor surface deposited on an inert substrate which is non-conductive to an electrical charge and is heated to a constant temperature by an embedded resistive heater, said metallic sensor surface and inert substrate being mounted rigidly near a further surface, said further surface being electrically biased negatively relative to the electrical potential of said metallic sensor surface, said metallic sensor surface being composed of a material having the property of causing said particulates intercepted thereupon to decompose by heat induced surface ionization and a positively charged ion burst to be emitted from the hot sensor surface for each particulate decomposition, each said positively charged ion burst being attracted towards said further surface, and means for registering each said positively charged ion burst having ion content larger than a predetermined amount by measuring current flow relative to said hot metallic sensor surface resulting from said bursts.

26. Apparatus in accordance with claim 25 wherein said metallic sensor surface is composed of platinum.

27. Apparatus in accordance with claim 25 wherein said metallic sensor surface is composed of either tungsten or of a alloy of platinum or one of the precious metals.

28. Apparatus in accordance with claim 25 wherein said metallic sensor surface is composed of a metallic oxide deposited onto or alloyed with substrate of platinum or other precious metal which in turn is deposited onto said inert, non-conducting substrate.

29. Apparatus in accordance with claim 25 wherein said inert non-conducting substrate is composed of aluminum oxide.

30. Apparatus in accordance with claim 25 wherein said inert non-conducting substrate is composed of quartz glass.

31. Apparatus in accordance with claim 25 wherein said embedded resistive heater is composed of platinum or an alloy thereof.

32. Apparatus in accordance with claim 25 wherein said embedded resistive heater is composed of tungsten, molybdenum or other refractory metal and is hermetically sealed inside said inert non-conducting substrate.

33. Apparatus in accordance with claim 25, comprising means for negatively biasing said further surface relative to said metallic sensor surface by at least about one hundred volts.

34. Apparatus in accordance with claim 25, wherein said means for registering each ion burst comprises detection means for detecting a change in current from said metallic sensor surface.

35. Apparatus in accordance with claim 25 wherein said further surface comprises a pipe that confines said moving gaseous medium.

36. An apparatus for monitoring particulates borne in a surrounding gaseous medium which is in motion relative to the apparatus comprising a metallic sensor surface deposited on an inert non-conducting substrate heated to a constant temperature by an embedded resistive heater, said metallic sensor surface and said inert non-conducting substrate being mounted rigidly near a further surface, said further surface being electrically biased negatively relative to the electrical potential of said metallic sensor surface and being in the form of a slotted tube, the slots in said tube being oriented in said moving gaseous medium so that the particulates freely pass through said slots and are intercepted onto said hot sensor surface, said metallic sensor surface being composed of a material having the property of causing said particulates intercepted thereupon to decompose by surface ionization and an ion burst to be emitted from the hot sensor surface for each particulate decomposition, each said ion burst being attracted towards said further surface, means for registering each said ion burst having ion content larger than a predetermined amount by measuring current flow relative to said hot surface resulting from said bursts, and further means being provided so that said tube may be rotated so as to block the flow of particulates through said slots, said rotation being for the purpose of providing a method of causing said apparatus to register zero counts.

37. An apparatus for monitoring particulates borne in a surrounding gaseous medium which is in relative motion with the apparatus comprising a metallic sensor surface deposited on an inert non-conducting substrate heated to a constant temperature by an embedded resistive heater; a further surface being mounted rigidly near said metallic sensor surface and inert non-conducting substrate, said further surface being electrically biased negatively relative to the electrical potential of said metallic sensor surface; and means for controlling the temperature of said metallic sensor surface, said means including a circuit for calculating the resistance of said embedded resistive heater which is governed by heater voltage, said calculated resistance controlling the duty factor of a switching transistor which is in said apparatus so that periodically a short pulse of voltage from a power supply is applied to said embedded resistive heater, said metallic sensor surface being composed of a material having the property of causing said particulates intercepted thereupon to decompose by surface ionization and an ion burst to be emitted from the hot sensor surface for each said particulate decomposition, each said ion burst being attracted towards said further surface, and means for registering each said ion burst having ion content larger than a predetermined amount be measuring current flow relative to said hot surface resulting from said bursts.

38. Apparatus in accordance with claim 37 comprising additional electronic means for measuring the time at which said pulse of voltage begins and ends thereby providing means for subsequent ion pulse counting circuitry to distinguish those electronic signals resulting from decomposition and surface ionization of particulates from those electronic signals resulting from electrostatic and magnetic induction during the turning on and the turning off of each said pulse of voltage being used to provide power to said embedded resistive heater.

* * * * *